United States Patent [19]

Lührsen et al.

[11] 4,290,589

[45] Sep. 22, 1981

[54] TEEMING PIPE FOR USE AT THE OUTLET OF A MELT CONTAINER

[75] Inventors: Ernst Lührsen, Bad Schwalbach; Heinz Schermer, Eltville, both of Fed. Rep. of Germany

[73] Assignee: Didier-Werke AG., Wiesbaden, Fed. Rep. of Germany

[21] Appl. No.: 130,444

[22] Filed: Mar. 14, 1980

[30] Foreign Application Priority Data

Mar. 17, 1979 [DE] Fed. Rep. of Germany ..... 2919880

[51] Int. Cl.[3] ..... C21C 5/42

[52] U.S. Cl. ..... 266/236; 138/114; 164/437; 222/594; 222/606; 285/302

[58] Field of Search ..... 266/236; 222/591, 594, 222/606; 164/437, 438, 133; 138/114, 120, 149, 155; 285/55, 298, 302, 303; 432/161; 65/126, 324, 325

[56] References Cited

U.S. PATENT DOCUMENTS

| | | | |
|---|---|---|---|
| 1,278,894 | 9/1918 | Falk | 285/302 |
| 2,051,323 | 8/1936 | Widmaier | 285/55 |
| 3,465,811 | 9/1969 | Castelet | 222/591 |
| 3,941,160 | 3/1976 | Campbell | 138/155 |
| 4,140,483 | 2/1979 | Errington | 138/149 |
| 4,228,826 | 10/1980 | Campell | 138/155 |

*Primary Examiner*—L. Dewayne Rutledge
*Assistant Examiner*—John P. Sheehan
*Attorney, Agent, or Firm*—Wenderoth, Lind & Ponack

[57] ABSTRACT

A refractory teeming pipe for use at the outlet of a melt container includes a refractory inner pipe member adapted to be connected to the outlet of a melt container, and a refractory outer pipe member telescopically slidably mounted about the inner pipe member for axial movement relative thereto between an upper retracted position and a lower extended position. The inner and outer pipe members include respective outer metal jackets. An upper refractory seal is supported by the outer pipe member and grips against the inner pipe member.

32 Claims, 2 Drawing Figures

TEEMING PIPE FOR USE AT THE OUTLET OF A MELT CONTAINER

BACKGROUND OF THE INVENTION

The present invention is directed to an improved refractory teeming or casting pipe for use at the outlet of a melt container during a teeming or casting operation. The present invention is specifically directed to such a teeming pipe of the type which is connected to a slide valve closure of a ladle and which surrounds or shrouds a turbulent melt discharge of steel from the ladle into an intermediate container of a continuous casting system.

The term "teeming pipe" is employed to refer to both the shadow or wake type pipes and immersion pipes or immersion exit nozzles. Wake or shadow-type pipes are simple, smooth pipes which serve to prevent reoxidation of steel into the teeming flow of steel during a teeming operation. Immersion pipes are additionally intended to produce a non-turbulent inflow or supply of the melt, for purposes of protecting against oxidation, along with a uniform distribution of the steel into a casting mold, and thus, include distribution channels at the exit end of the immersion pipe. In a continuous casting system, a wake or shadow pipe is located at the outlet of the ladle which supplies the melt to an intermediate container, and in turn, the melt is fed from the intermediate container to the casting mold through an immersion pipe. Such system includes plugs or slide valve closures at the exit nozzles of the ladle and the intermediate container. The respective teeming pipes are attached in an easily removable fashion to the outlet nozzle or to the slide valve closure, and communication through the respective teeming pipes is easily achieved by operation of the plugs or the slide valve closures. Both types of teeming pipes are partially immersed in the respective portions of the melt in the operating positions of the teeming pipes.

SUMMARY OF THE INVENTION

With the above discussion in mind, the primary object of the present invention is to provide a teeming pipe for use in a continuous casting system wherein the space between the discharge and receiving melt containers of the system is less than the length of the teeming pipe in the operative position thereof.

It is a more specific object of the present invention to provide such a teeming pipe which is adapted to be attached to a slide valve closure closing the outlet of a ladle and which, when the slide valve closure is open, surrounds a flow of melt from the ladle to an intermediate container.

It is a further object of the present invention to provide such a teeming pipe whereby the discharge and receiving melt containers need not be moved with respect to each other in vertical directions to enable the teeming pipe to be moved into the operative position thereof.

The above objects are achieved in accordance with the present invention by the provision of a refractory teeming pipe for use at the outlet of a melt container, the teeming pipe including a refractory inner pipe member adapted to be connected to the outlet of a discharge melt container, and a refractory outer pipe member telescopically slidably mounted about the inner pipe member for axial movement relative thereto between an upper retracted position and a lower extended position.

Thus, with the outer pipe member in the upper retracted position, the discharging melt container, for example, a ladle, may readily be moved in a horizontal direction to a position above the receiving melt container, for example, an intermediate melt container of a continuous casting operation, without the necessity of moving the ladle and intermediate container in vertical directions relative to each other. When the ladle is properly positioned above the intermediate container, the outer pipe member of the teeming pipe may be lowered to its lower extended position, at which time the outer pipe member will extend downwardly into the intermediate container. By this arrangement, the teeming pipe may be properly positioned, even when the vertical space between the ladle and intermediate container is less than the length of the teeming pipe. It will be apparent that such capability is not possible with previously known teeming pipes. Furthermore, when the teeming pipe is thus located in its operative position, and when the slide valve closure is opened, if the melt does not immediately begin to flow, for example, due to the outlet being plugged by frozen melt, the outer pipe member may be raised toward its upper retracted position, and oxygen, for example, may be supplied to the slide valve closure to render the frozen melt flowable again. When the frozen melt is again flowable, the outer pipe member will then be returned to its lower extended position. Furthermore, the arrangement of the teeming pipe in accordance with the present invention enables the immersion depth of the attached teemping pipe in the teeming position to be varied. This makes it possible to make up for or replace worn immersion portions or regions of the teeming pipe. Furthermore, the hazard of burning air aspirating holes in the teeming pipe due to fluttering as a result of the wider flow region of the outer pipe member is substantially avoided due to the ability to increase the immersion depth.

In accordance with a further feature of the present invention, the inner and outer refractory pipe members include respective outer metal jackets.

The outer pipe member surrounds the inner pipe member with a narrow annular gap therebetween. An upper refractory seal is supported by the outer pipe member adjacent the end thereof closest to the ladle, the upper refractory seal closing the upper end of the annular gap. The refractory seal may be of a known type refractory fiber material. An additional refractory seal is supported by the outer pipe member at a position spaced beneath the upper refractory seal. The additional refractory seal defines with the upper refractory seal an annular space. The additional refractory seal is somewhat permeable to gas, and a gas supply pipe may extend through the outer pipe member and open into the annular space. Thereby, it is possible to introduce an inert gas into the annular space. This inert gas will, to a certain extent, pass through the lower additional refractory seal and be supplied to the immersed end of the teeming pipe to protect against oxidation of the melt and to counteract the deposition of metal particles on the inside of the teeming pipe. The upper refractory seal hermetically seals the upper end of the annular space, and is dimensioned to grip and hold against the inner pipe member. Thus, the upper refractory seal forms a self-locking or automatic gripping device for holding the outer pipe member at selected positions on the inner pipe member. Additionally, however, one or more pin connections may be provided to extend through the outer pipe member and into the inner pipe member to fix the outer pipe member to the inner pipe member at desired positions thereof, for example, at least the retracted end extended positions. By these features of the present invention, wear of the teeming pipe is reduced and, as wear of the teeming pipe does occur, the teeming pipe may be adjusted to accommodate for such wear.

Further, there is provided an arrangement for adjustably moving the outer pipe member between the retracted and extended positions. Such moving arrangement may include a fork-shaped movable positioning mechanism which is mounted on one of the melt containers and which includes fork arms extending into receiving holes on abutment members attached to the outer pipe member. Thereby, upward and downward movement of the arms will result in corresponding upward and downward movements of the outer pipe member.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
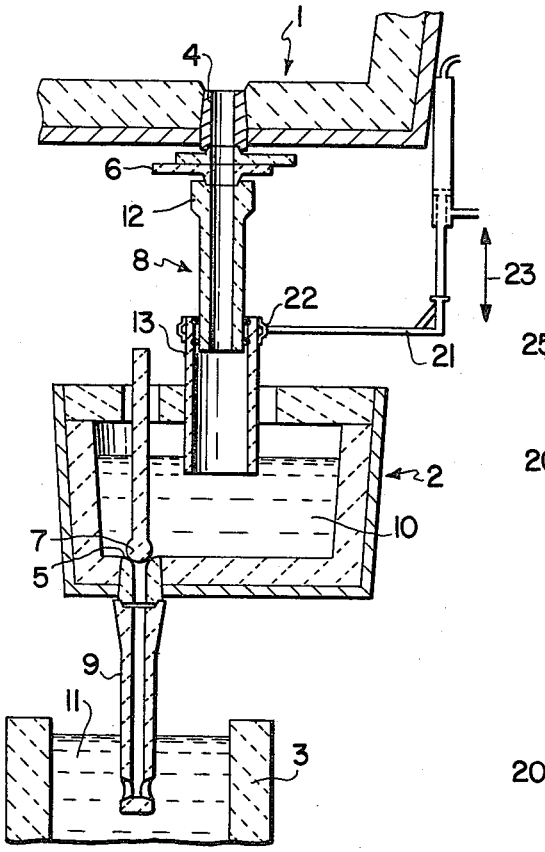
FIG. 1 is a schematic partial cross-sectional view of a continuous casting system including a teeming pipe according to the present invention.

As shown in FIG. 1, a continuous casting system includes a steel ladle 1, an intermediate container 2, and a continuous casting mold 3. A melt, for example, molten steel, is discharged through various ladles 1 which are sequentially positioned above intermediate container 2, and the melt is continuously discharged from intermediate container 2 into mold 3. The ladle 1 is specifically intended to be rapidly replaced by another ladle for sequential teeming into the intermediate container, and for this purpose, the ladle 1 is supported by a known type ladle turret (not shown) mounted on a continuous casting platform (not shown).

A known type refractory slide valve closure 6 controls the overflow of the melt from the outlet nozzle 4 of the ladle 1. A known type refractory plug 7 controls the outflow of the melt through the outlet nozzle 5 of the intermediate container 2. Refractory teeming pipes 8 and 9 are provided for respectively supplying the melt from the ladle to the intermediate container and from the intermediate container to the mold, and teeming pipes 8 and 9 are positioned to have their lower free ends immersed in the respective melts 10 and 11. Teeming pipe 8 is a wake or shadow pipe which surrounds the teeming flow of melt and protects such flow of melt from reoxidation. Teeming pipe 9 is an immersion nozzle pipe which also provides oxidation protection, and which additionally distributes the melt over the cross-section of the mold 3.

In the drawings, the pipe 8 has been illustrated as the novel teeming pipe of the present invention. It is, however, to be understood that the immersion pipe 9 may additionally or alternatively be constructed in accordance with the novel features of the present invention.

Figure 2:
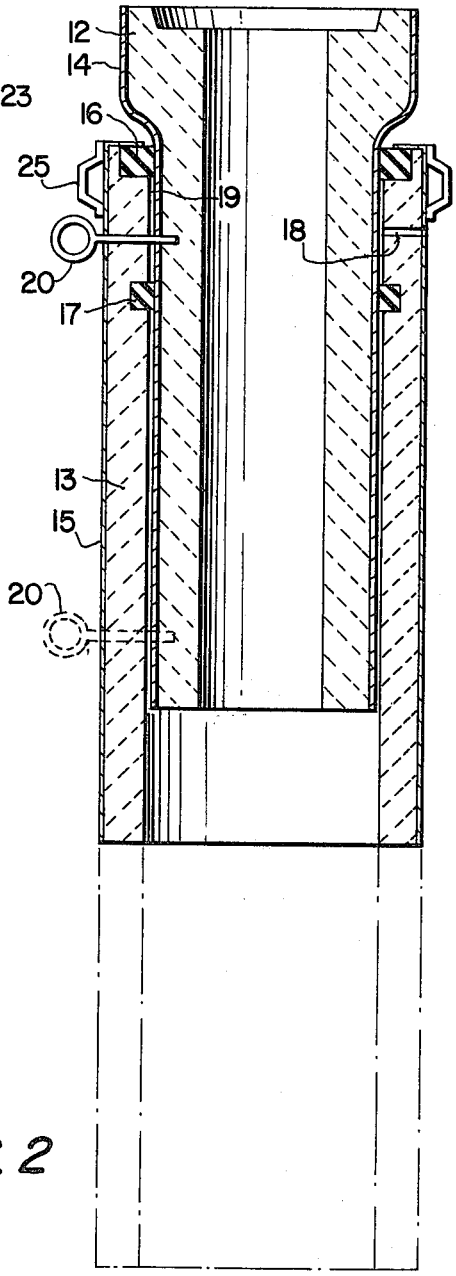
FIG. 2 is an enlarged cross-sectional view in more detail of the teeming pipe of FIG. 1.

As shown in the drawings, the novel teeming pipe of the present invention includes an inner pipe 12 connected to the slide plate of the slide valve closure 6 at the outlet 4 of the ladle 1. The teeming pipe of the present invention further includes an outer pipe 13 telescopically slidably mounted about the inner pipe 12 for axial movement relative thereto between an upper retracted position, shown in solid lines in FIG. 2, and a lower extended and operative position, shown in solid lines in FIG. 1 and dashed lines in FIG. 2. Pipe members 12 and 13 are of a approximately the same length. The pipe members 12 and 13 include respective outer metal jackets 14 and 15.

The outer pipe member 13 surrounds the inner pipe member with a narrow annular gap therebetween. An upper refractory seal 16 is supported by the outer pipe member 13 adjacent the upper end thereof closest to ladle 1. Upper refractory seal 16 closes the upper end of the annular gap. Upper refractory seal 16 is a friction seal and is dimensioned to be self-locking or to automatically grip and hold against the inner pipe member 12, to thereby prevent uncontrolled sliding of outer pipe member 13 with respect to inner pipe member 12. Refractory seal 16 essentially hermetically seals the upper end of the annular gap.

An additional refractory seal 17 is supported by the outer pipe member 13 at a position spaced beneath the upper refractory seal 16. Additional refractory seal 17 defines with the upper refractory seal 16 an annular space 19. Additional refractory seal 17 is somewhat permeable to gas. A gas supply pipe 18 extends through the outer pipe member 13 and opens into space 19, and an inert gas, for example argon, may be supplied in space 19 which thus forms a gas collecting space. Due to the somewhat permeable nature of refractory seal 17, the gas may be supplied downwardly therethrough toward the free end of the inner pipe 12 to prevent metal deposition and buildup. Additionally, one or more connecting pins, for example, cotter pins 20, may extend through outer pipe member 13 to be received in recesses in inner pipe member 12 to maintain the outer pipe member 13 in various desired positions thereof, for example, at least the retracted and extended positions thereof.

In accordance with a further feature of the present invention, an arrangement is provided for sliding the outer pipe member 13 with respect to the inner pipe member 12. Specifically, a positioning mechanism 21 may include a fork-shaped end 22 having arms which fit into receiving openings of abutment or attachment members 25 mounted on the outer pipe member 13. The positioning mechanism may be mounted on one of the melt containers, most preferably on the ladle 1 as shown in FIG. 1. In the illustrated arrangement, the positioning mechanism is a piston-cylinder arrangement, whereby operation of the piston will move the member 21 in vertical directions as shown by the arrow 23. Such movement will thus result in vertical movement of the outer pipe member 13 with respect to the inner pipe member 12.

Although it is believed that operation of the system including the novel teeming pipe of the present invention will be apparent from the above discussion, such operation will be briefly described below. Thus, the teeming pipe 8 is in its retracted position and is connected in a known manner to the slide valve closure 6 of a particular ladle 1. Preferably, this positioning is achieved before the particular ladle 1 is positioned above the intermediate container 2. With the teeming pipe 8 in its retracted position, the ladle 1 is swung over the intermediate container 2. Due to the fact that the teeming pipe 8 is in its retracted position, the ladle 1 and intermediate container 2 do not have to be moved in vertical directions with respect to each other. When the ladle 1 is properly positioned above the intermediate container 2, the mechanism 21 is operated to lower the outer pipe member 13 to the extended position thereof, i.e., the teeming position, as shown in FIG. 1, and the slide valve closure is then operated to discharge the melt from the ladle. If the melt does not initially flow, due to a possible freeze up in the outlet 4, then the outer pipe member 13 may be easily moved to the upper retracted position thereof, thereby providing easy accessibility for a bent lance to supply oxygen through the teeming pipe to melt the freeze up. When the freeze up is overcome, the outer pipe member 13 is again lowered to its extended position, and the teeming operation is carried out. It, of course, will be apparent that connecting pins 20 will be operated as necessary to allow change of position of the outer pipe member 13.

After the completion of teeming from a given ladle 1, it is in most cases unnecessary to move the outer pipe member 13 to the upper retracted position, since the ladle 1 may merely be swung away from the intermediate container, whereby the teeming pipe 8 will impact and be broken away, since the connection between the teeming pipe 8 and the slide valve closure will have become brittle. The part which is broken away will float on the slag layer in the intermediate container 2 and can be removed therefrom. Alternatively, however, the movement of the outer pipe member 13 can be carried out in both upward and downward vertical directions by means of the mechanism 21.

Although the present invention has been described and illustrated with respect to a preferred embodiment thereof, it will be apparent that various modifications may be made without departing from the scope of the present invention. It is specifically to be understood that the immersion pipe 9 may be constructed in accordance with the improved teeming pipe configuration of the present invention.

What is claimed is:

1. A refractory teeming pipe for use at the outlet of a melt container used in a teeming or casting operation, said teeming pipe comprising:

a refractory inner pipe member adapted to be connected to the outlet of a melt container;

a refractory outer pipe member telescopically slidably mounted about said inner pipe member for axial movement relative thereto between an upper retracted position and a lower extended position, said outer pipe member surrounding said inner pipe member with a narrow annular gap therebetween; and an upper refractory seal supported by said outer pipe member adjacent the end thereof closest to the melt container, said upper refractory seal closing one end of said annular gap.

2. A teeming pipe as claimed in claim 1, wherein said inner and outer pipe members include respective outer metal jackets.

3. A teeming pipe as claimed in claim 1, further comprising an additional refractory seal supported by said outer pipe member at a position spaced from said upper refractory seal, said additional refractory seal defining with said upper refractory seal an annular space.

4. A teemping pipe as claimed in claim 3, wherein said additional refractory seal is permeable to gas, and further comprising means for supplying a gas to said annular space between said refractory seals.

5. A teeming pipe as claimed in claim 1, wherein said upper refractory seal comprises gripping means for holding said outer pipe member at selected positions on said inner pipe member.

6. In a teeming or casting system of the type including an upper melt container containing a melt and having a selectively closeable outlet nozzle through which said melt is to be teemed, a lower melt container positioned to receive said melt from said outlet nozzle of said upper melt container, and a refractory teeming pipe connected to said outlet nozzle and through which said melt passes to said lower melt container, the improvements wherein said upper and lower melt containers are immovable with respect to each other in vertical directions, and wherein said teeming pipe comprises:

a refractory inner pipe member connected to said outlet nozzle of said upper melt container; and a refractory outer pipe member telescopically slidably mounted about said inner pipe member for axial movement relative thereto between an upper retracted position, whereat said outer pipe member is entirely positioned above and does not extend into said lower melt container, and a lower extended position, whereat said outer pipe member extends downwardly into the interior of said lower melt container.

7. The improvement claimed in claim 6, wherein said inner and outer pipe members include respective outer metal jackets.

8. The improvement claimed in claim 6 or 7, wherein said outer pipe member surrounds said inner pipe member with a narrow annular gap therebetween.

9. The improvement claimed in claim 8, further comprising an upper refractory seal supported by said outer pipe member adjacent the end thereof closest to said upper melt container, said upper refractory seal closing one end of said annular gap.

10. The improvement claimed in claim 9, further comprising an additional refractory seal supported by said outer pipe member at a position spaced from said upper refractory seal, said additional refractory seal defining with said upper refractory seal an annular space.

11. The improvement claimed in claim 10, wherein said additional refractory seal is permeable to gas, and further comprising means for supplying a gas to said annular space between said refractory seals.

12. The improvement claimed in claim 9, wherein said upper refractory seal comprises gripping means for holding said outer pipe member at selected positions on said inner pipe member.

13. The improvement claimed in claim 6, further comprising pin connection means for fixing said outer pipe member to said inner pipe member at said retracted and extended positions.

14. The improvement claimed in claim 6, further comprising means for adjustably moving said outer pipe member between said retracted and extended positions.

15. The improvement claimed in claim 14, wherein said moving means comprises a fork-shaped movable positioning mechanism adapted to be attached to one of said melt containers and having arms, and abutment means on said outer pipe member and dimensioned to receive said arms.

16. A refractory teeming pipe for use at the outlet of a melt container used in a teeming or casting operation, said teeming pipe comprising:

a refractory inner pipe member adapted to be connected to the outlet of a melt container;

a refractory outer pipe member telescopically slidably mounted about said inner pipe member for axial movement relative thereto between an upper retracted position and a lower extended position; and pin connection means for fixing said outer pipe member to said inner pipe member at said retracted and extended positions.

17. A teeming pipe as claimed in claim 16, wherein said inner and outer pipe members include respective outer metal jackets.

18. A teeming pipe as claimed in claim 16 or 17, wherein said outer pipe member surrounds said inner pipe member with a narrow annular gap therebetween.

19. A teeming pipe as claimed in claim 18, further comprising an upper refractory seal supported by said outer pipe member adjacent the end thereof closest to the melt container, said upper refractory seal closing one end of said annular gap.

20. A teeming pipe as claimed in claim 19, further comprising an additional refractory seal supported by said outer pipe member at a position spaced from said upper refractory seal, said additional refractory seal defining with said upper refractory seal an annular space.

21. A teeming pipe as claimed in claim 20, wherein said additional refractory seal is permeable to gas, and further comprising means for supplying a gas to said annular space between said refractory seals.

22. A teeming pipe as claimed in claim 19, wherein said upper refractory seal comprises gripping means for holding said outer pipe member at selected positions on said inner pipe member.

23. A teeming pipe as claimed in claim 16, further comprising means for adjustably moving said outer pipe member between said refracted and extended positions.

24. A teeming pipe as claimed in claim 23, wherein said moving means comprises a fork-shaped movable positioning mechanism adapted to be attached to the melt container and having arms, and abutment means on said outer pipe member and dimensioned to receive said arms.

25. A refractory teeming pipe for use at the outlet of a melt container used in a teeming or casting operation, said teeming pipe comprising:

a refractory inner pipe member adapted to be connected to the outlet of a melt container;

a refractory outer pipe member telescopically slidably mounted about said inner pipe member for axial movement relative thereto between an upper retracted position and a lower extended position; and means for adjustably moving said outer pipe member between said retracted and extended positions.

26. A teeming pipe as claimed in claim 25, wherein said moving means comprises a fork-shaped movable positioning mechanism adapted to be attached to the melt container and having arms, and abutment means on said outer pipe member and dimensional to receive said arms.

27. A teeming pipe as claimed in claim 25, wherein said inner and outer pipe members include respective outer metal jackets.

28. A teeming pipe as claimed in claim 25 or 27, wherein said outer pipe member surrounds said inner pipe member with a narrow annular gap therebetween.

29. A teeming pipe as claimed in claim 28, further comprising an upper refractory seal supported by said outer pipe member adjacent the end thereof closest to the melt container, said upper refractory seal closing one end of said annular gap.

30. A teeming pipe as claimed in claim 29, further comprising an additional refractory seal supported by said outer pipe member at a position spaced from said upper refractory seal, said additional refractory seal defining with said upper refractory seal in annular space.

31. A teeming pipe as claimed in claim 30, wherein said additional refractory seal is permeable to gas, and further comprising means for supplying a gas to said annular space between said refractory seals.

32. A teeming pipe as claimed in claim 29, wherein said upper refractory seal comprises gripping means for holding said outer pipe member at selected positions on said inner pipe member.

* * * * *